US010557621B2

(12) United States Patent
Gietl et al.

(10) Patent No.: US 10,557,621 B2
(45) Date of Patent: Feb. 11, 2020

(54) SOCKET ASSEMBLY FOR RECEIVING A LAMP HAVING A PINCH SEAL

(71) Applicant: BLV Licht- und Vakuumtechnik GmbH, Steinhoering (DE)

(72) Inventors: Georg Gietl, Steinhoering (DE); Dragan Simsic, Steinhoering (DE); Thorsten Baum, Steinhoering (DE)

(73) Assignee: BLV Licht- und Vakuumtechnik GmbH, Steinhoering (DE)

( * ) Notice: Subject to any disclaimer, the term of this patent is extended or adjusted under 35 U.S.C. 154(b) by 0 days.

(21) Appl. No.: 16/433,575

(22) Filed: Jun. 6, 2019

(65) Prior Publication Data

US 2019/0376674 A1 Dec. 12, 2019

(30) Foreign Application Priority Data

Jun. 8, 2018 (DE) ..... 10 2018 004 589

(51) Int. Cl.

| | |
|---|---|
| ***F21V 21/14*** | (2006.01) |
| ***H01R 13/64*** | (2006.01) |
| ***F21K 9/272*** | (2016.01) |
| ***H01K 1/46*** | (2006.01) |

(52) U.S. Cl.

CPC ..... *F21V 21/14* (2013.01); *F21K 9/272* (2016.08); *H01K 1/46* (2013.01); *H01R 13/64* (2013.01)

(58) Field of Classification Search

CPC ..... F21V 21/14; H01R 13/64; F21K 9/272; H01K 1/46

See application file for complete search history.

(56) References Cited

U.S. PATENT DOCUMENTS

| | | | | |
|---|---|---|---|---|
| 4,998,040 A | | 3/1991 | Emunds et al. | |
| 5,531,613 A | * | 7/1996 | Takano | H01R 33/09 439/544 |
| 2013/0170194 A1 | | 7/2013 | Osada | |

FOREIGN PATENT DOCUMENTS

| | | |
|---|---|---|
| DE | 39 03 892 A1 | 8/1990 |
| NL | 1029855 C2 | 11/2006 |

* cited by examiner

*Primary Examiner* — Thomas M Sember
(74) *Attorney, Agent, or Firm* — Wood Herron & Evans LLP

(57) ABSTRACT

A socket assembly for receiving a lamp with a pinch seal and a connecting pin led out therethrough is provided having an outer housing part with an essentially cylindrical cavity which is accessible from outside via a slotted opening extending in a longitudinal direction of the outer housing part, an inner part mounted for rotation about a rotation axis (R) inside the outer housing part and including a free space which is configured for receiving the pinch seal and the connecting pin and is accessible from outside, and two opposed leaf springs for fixation of the pinch seal in the free space.

16 Claims, 10 Drawing Sheets

SOCKET ASSEMBLY FOR RECEIVING A LAMP HAVING A PINCH SEAL

CROSS-REFERENCE TO RELATED APPLICATION

The present application claims priority under 35 U.S.C. § 119 of German Patent Application No. 102018004589.8, filed Jun. 8, 2018, the disclosure of which is hereby incorporated herein by reference in its entirety.

FIELD OF THE INVENTION

The present invention relates to a socket assembly for receiving a lamp with a pinch seal and a connecting pin led out of said pinch seal for connecting the lamp to a voltage source.

BACKGROUND OF THE INVENTION

In this regard, socket assemblies are known in which an inner part with a free space for receiving the pinch seal and the connecting pin is rotatably arranged in an essentially cylindrical cavity of an outer housing part. The two parts have slotted openings in their outer surfaces which, when congruent with one another, allow insertion of the pinch seal and the connecting pin into the free space of the inner part from outside. The pinch seal is fixed in the free space by two opposed spring clips which rest against the surfaces of the pinch seal. The lamp is secured in the socket assembly through rotation of the inner part relative to the outer housing part, which causes the slotted openings to shift relative to one another and close. At the same time, an electrical contact is established between the connecting pin, and thus the electric circuit of the lamp, and the voltage source. Such an arrangement is described, for example, in NL 1029855 C.

The known socket assemblies are, however, disadvantageous in that it is oftentimes difficult to securely fix lamps from different manufacturers or lamps with manufacturing tolerances in the region of the pinch seal. For example, the pinch seals of lamps made by different manufacturers differ from one another. The shape of the pinch seal essentially corresponds to an "H" with short parallel struts. However, these struts vary in thickness and height depending on the manufacturer, and in some cases the parallel struts are entirely omitted. The thickness of the planar region of the pinch seal may likewise vary depending on the manufacturer. Moreover, manufacturing tolerances exist in all mentioned regions even for lamps made by one and the same manufacturer. These deviations complicate either the installation of the lamp in the socket assembly or its secure fixation therein. For example, if the distance between the spring clips is reduced or their tension is increased in order to also enable secure fixation of thinner pinch seals, there is a risk that the insertion of lamps having thicker pinch seals into the socket assembly becomes very difficult and the pinch seal might even be broken in the attempt. Conversely, if the distance between the spring clips is increased or their preload is reduced, the lamps are no longer securely fixed in the socket assembly, which may result in failure to reliably establish the electrical contact or in damage to the lamps due to looseness inside the socket assembly.

Accordingly, the object of the present invention is to provide a socket assembly for receiving a lamp with a pinch seal and a connecting pin led out therethrough which avoids the disadvantages described above and also enables secure fixation of lamps having manufacturing tolerances in the region of the pinch seal.

SUMMARY OF THE INVENTION

In a first aspect, the present invention thus relates to a socket assembly for receiving a lamp with a pinch seal and a connecting pin led out therethrough, comprising:

an outer housing part with an essentially cylindrical cavity which is accessible from outside via a slotted opening extending in a longitudinal direction of the outer housing part, an inner part mounted for rotation about a rotation axis inside the outer housing part and including a free space which is configured for receiving the pinch seal and the connecting pin and which is accessible from outside, and two opposed leaf springs for fixation of the pinch seal in the free space, wherein each of the leaf springs is bent from a metal strip such that a linear resting face is formed which is adjoined on both sides by leg portions that are angled relative to the resting face and that are adjoined, at their ends distant from the resting face, by base portions running towards one another, said base portions turning into shaft portions that extend away from the resting face, wherein said leaf springs are attached to the inner part in the region of the shaft portions and the resting faces face each other and are essentially parallel to one another.

The basic structure of the socket arrangement according to one embodiment of the present invention thus essentially corresponds to known prior art configurations and likewise has an inner part mounted inside an outer housing part with an essentially cylindrical cavity. In this regard, an essentially cylindrical cavity is to be understood to mean a cavity which allows a rotation of the inner part about a rotation axis which typically extends in the direction of longitudinal extension of the inner part and the direction of longitudinal extension of the lamp. If the lamp includes only one connecting pin for electrically contacting the socket assembly, the rotation axis usually corresponds to the direction of longitudinal extension of the connecting pin. However, the present invention can generally also be applied to lamps with multiple connecting pins. Deviations from the cylindrical shape of the cavity are thus possible as long as they do not affect the described rotation of the inner part inside the outer housing part. The inner part does not need to be able to rotate about 360° inside the outer housing part; instead, a smaller angular range, for example, up to between 90° and 180°, is sufficient. The cavity of the outer housing part is preferably configured such that the inner part can be rotated both clockwise and counter-clockwise.

The inner part is configured to be complementary to the outer housing part such that it can be rotated inside the latter about a rotation axis which typically corresponds to the direction of longitudinal extension of the inner part. It comprises a free space accessible from outside in which the pinch seal and the connecting pin led out of the pinch seal can be received. "Accessible from outside" here means that if the inner part and the outer housing part are arranged in a suitable orientation relative to one another, the pinch seal and the connecting pin can be inserted through the slotted opening of the outer housing part and into the free space of the inner part. The inner part is then advantageously configured such that the slotted opening is closed by the outer wall of the inner part when the inner part is rotated from the position allowing access from outside to a closed position.

At the same time, the wall of the outer housing part blocks the access to the free space of the inner part. Furthermore, the socket assembly is preferably configured such that the rotation of the inner part relative to the outer housing part from the open position to a closed position results in an electrical contact between the connecting pin and the current-carrying elements of the socket assembly and eventually the voltage source.

The socket assembly according to one embodiment of the present invention is characterized by a special configuration of the leaf springs used to fix the pinch seal of the lamp in the free space of the inner part. As in the prior art, the leaf springs are arranged opposite one another in the inner part of the socket assembly so as to hold the pinch seal of the lamp between them. Each of the leaf springs is formed from a metal strip, both leaf springs preferably being configured identically so as to clamp the pinch seal of the lamp uniformly from both sides. Thus, the descriptions given below with respect to one leaf spring equally apply to the opposed second leaf spring. The leaf spring is bent from a metal strip such that a linear resting face is formed. This resting face rests against one of the flat surfaces of the pinch seal and exerts a more uniform pressure on a larger surface area of the pinch seal compared to prior art spring clips. The length of the resting face is preferably sized such that it amounts to at least 50%, preferably at least 70%, more preferably at least 80%, and, in particular, at least 90% of the width of the pinch seal (transversely to the direction of longitudinal extension of the lamp). Due to the larger extension of the resting face, the pressure per unit area can be reduced significantly compared to that of a spring clip, so that the local load on the pinch seal, and thus the risk of damaging the same, is minimized.

The resting face of the leaf spring is on both sides adjoined by leg portions that are angled relative to the resting face. The leg portions lead away from the pinch seal and may have a linear or curved progression. The leg portions are in turn adjoined by base portions that run towards one other and may extend either parallel or at an angle to the resting face. The base portions turn into shaft portions which extend away from the resting face and at which the leaf spring is attached to the inner part. The bends of the metal strip in the transition regions between the individual portions of the leaf spring may each be sharp-edged or rounded. The individual portions of the leaf spring and the bends therebetween are preferably configured such that a symmetrical design is obtained, in particular a mirror-symmetrical design with respect to a central plane perpendicular to the rotation axis, i.e., a plane extending through the center of the resting face and between the shaft portions.

The angle between the resting face and each of the leg portions is preferably an obtuse angle, for example, in the range from 110 to 160°, preferably 130 to 150°. Two opposed leaf springs arranged such that their resting faces face one another thus result in a funnel-like access region on each side, said access region narrowing towards the resting faces. This facilitates the insertion of the pinch seal into the region between the resting faces since the leg portions serve as guide faces for the pinch seal and direct the latter towards the gap between the resting faces. Since, as described, a symmetrical configuration of the leaf spring is preferred, an approximately trapezoidal shape is obtained for the head region of the leaf spring, and a mushroom-like contour for the entire leaf spring.

Unlike the prior art spring clips, the leaf springs according to one embodiment of the present invention have a shaft region in which the leaf springs are attached to the inner part. This is preferably done such that the leaf springs are attached to the inner part only in their region of the shaft portion that is distant from the respective resting face, preferably such that their regions projecting over the respective shaft portion are deformable towards the shaft region. More specifically, this means that the projecting regions protrude beyond the adjacent surface of the inner part and are arranged at a distance from the latter that provides for clearance for movement and deformation. This arrangement allows, for example, tilting of the head region of the leaf spring, so that one side of the head region can lean towards the adjacent shaft portion and towards the inner part. This also facilitates the insertion of the pinch seal into the region between the opposed leaf springs. When the pinch seal is inserted with one of its end faces into the gap between the leaf springs, the latter can tilt to back away under the pressure exerted by the pinch seal, so that less force needs to be applied to insert the pinch seal into the gap, and the pressure load on the pinch seal is reduced. At the same time, the distance between the resting faces of the opposed leaf springs can be increased through deformation of each leaf spring. The further the pinch seal is inserted into the gap between the leaf springs the more the latter return to their upright position and expand until finally the resting faces of both compression springs are essentially parallel to one another and bear against the opposite surfaces of the pinch seal. "Essentially parallel" here means that approximately parallel positions, which are, in particular, due to manufacturing tolerances, for example positions in which the opposite surfaces of the pinch seal are not exactly parallel to one another and cause an inclination of the resting faces, are to be encompassed by the present invention. Deviations from parallelism by an angle of up to 3° are in any case encompassed by this definition. However, a parallel orientation of the resting faces of the opposite leaf springs that is as exact as possible is in each case preferred.

Due to the very flexible configuration of the leaf spring and its large resting face, the leaf spring can adapt much better even to differently shaped pinch seals without exerting too much pressure on the pinch seal during the insertion or removal of the lamp from the socket assembly. Nevertheless, the tension with which the leaf springs are preloaded towards one another can still be set high enough to enable even the secure fixation of pinch seals having a small thickness without rendering their insertion and removal too difficult.

The metal strip from which the leaf springs are formed can be closed to obtain a continuous strip. However, this is not mandatory. It is already sufficient and much less complicated to leave the free ends of the metal strip in the finished leaf spring open. The opening between the free ends is preferably located at the shaft region facing away from the resting face, preferably in the outermost bottom region of the leaf spring. The free ends of the shaft portions may be bent towards each other in this configuration. This facilitates the attachment of the leaf spring to the inner part. Generally, any type of attachment may be used. In the context of the present invention, however, it is preferred to attach the leaf spring to the inner part using a slip connection. The end regions of the shaft portions are then particularly preferably slipped into complementary grooves formed in the inner part. The bent ends then prevent the leaf spring from slipping off.

The material used for the metal strip of the leaf springs may generally be any prior art material known to be suitable for manufacturing springs. Metallic materials such as steel and, in particular, spring steel are preferred.

Another improvement according to one embodiment of the present invention relates to the electrical contact between the connecting pin and the socket assembly. As in the prior art, the electrical contact is likewise established and interrupted through rotation of the inner part relative to the outer housing part, which is done in a known manner such that in the open position, in which the pinch seal and the connecting pin of the lamp can be inserted into the free space of the inner part, there is no electrical contact, and said contact is established through rotation of the inner part to a closed position in which the lamp cannot be removed from the socket assembly. According to one embodiment of the present invention, the electrical contact between the socket assembly and the connecting pin is established using a contact spring with an essentially U- or V-shaped body. The contact spring is mounted at a support projection of the outer housing part which protrudes into the free space, and can be connected to an external voltage source. For example, a current-conducting cable may be connected to the contact spring, led out of the outer housing part and coupled to an external voltage source. If the lamp has multiple connecting pins, each is provided with a respective contact, the latter being configured such that an electrical contact is established through rotation to a closed position.

The contacting pin of the lamp bears against a current collector rail thereby forming an electrical contact. In the case of multiple pins, each is provided with a respective current collector rail. For a lamp with one connecting pin, the current collector rail is attached to the inner part such that it comes to rest between the legs of the contact spring, and can rotate with the inner part. The legs of the contact spring and the current collector rail are spaced from one another when the inner part and the outer housing part are in the open position, whereas a contact surface of the current collector rail contacts one of the legs of the contact spring when the inner part and the outer housing part are in a closed position, so that an electrical contact is established between the current collector rail and the contact spring and thus between the voltage source and the connecting pin of the lamp.

The present invention relates not only to the contact spring and/or the current collector rail in combination with the described leaf springs but also to the contact spring and the current collector rail individually, or a combination of leaf springs and contact spring, leaf springs and current collector rail, or contact spring and current collector rail. This also applies to the preferred embodiments of these elements as described below. The materials used for the contact spring and the current collector rail may be the same as for the leaf springs, i.e., metals, in particular steel, preferably high-grade steel or spring steel.

The electrical contact between the contact surface of the current collector rail and the contact spring may be established solely due to the corresponding shaping and arrangement of these parts relative to one another as a result of the rotation of the inner part relative to the outer housing part. In a preferred variant of the present invention, however, the process of establishing the contact is additionally supported by a reduction of the free space in the inner part caused by the rotation of the inner part relative to the outer housing part to a closed position, so that the contact surface and the contact spring are brought closer together. In the same manner, it is also possible to reduce the free space in the region of the leaf springs to increase the pressure exerted on the surfaces of the pinch seal by the resting faces in the closed position. According to one embodiment of the present invention, this is achieved through at least one of the following measures:

a) a circumferential portion of the essentially cylindrical cavity has, at least in regions in the direction of the rotation axis, a diameter which is reduced relative to a circular cross-section;

b) a circumferential portion of the inner part has, at least in regions in the direction of the rotation axis, a diameter which is enlarged relative to a circular cross-section.

Depending on the longitudinal portion, i.e., the region of the cylindrical cavity of the outer housing part and/or the outer circumference of the inner part in the direction of the rotation axis, exhibiting the change in diameter, the reduction of the free space has an effect on either the position of the contact spring and the current collector rail relative to one another and/or the position of the leaf springs relative to one another. The change in diameter may be constant along the entire length or it may be different in the region of the contact spring and the current collector rail compared to the region of the leaf springs. In this manner, it is possible to selectively adjust the reduction of the free space in the closed position for the various regions. For example, the cylindrical cavity of the outer housing part may have a constriction only in the region of the leaf springs, said constriction consisting, for example, in regions that are oblate compared to an otherwise circular cross-section, said oblate regions being located in radially opposed regions that come to rest parallel to the resting faces of the leaf springs in the closed position and thus push the leaf springs towards one another. The same effect can be achieved by enlarging the outer diameter of the inner part in the corresponding regions. The two measures may also be combined. Moreover, the same effect can also be achieved in the described manner in the region of the contact spring.

For the reduction of the free space of the inner part to have a particularly strong effect on the contact spring and its position relative to the current collector spring, a lateral projection is preferably provided on at least one external side of a leg of the contact spring. A sidewall region delimiting the free space rests against this projection when the inner part and the outer housing part are in a closed position and the free space is reduced. The legs are thus pressed against each other, and a contact with the contact surface of the current collector rail is established particularly easily. The external sides of both legs of the contact spring are preferably provided with lateral projections, so that the contact spring is compressed uniformly from both sides upon rotation of the inner part to a closed position. The projection may basically have any shape as long as the intended purpose is achieved. In a preferred variant, projections are created on both sides through a spring ring which is passed through openings in the legs of the contact spring and lies in a plane that intersects orthogonally with both legs. The spring ring is interrupted at one point of its circumference, and its free ends are attached in a region of the legs that is oriented towards the open end of the contact spring. The openings in the legs through which the contact spring is passed are located closer towards the connecting region of the legs. As a result, bracket-shaped projections are formed on the external sides of the legs which compress the contact spring when the inner part is rotated to a closed position.

The current collector rail, which is formed from an electrically conductive material, in particular metal, is formed such that it can accommodate the connecting pin of the lamp. It is therefore arranged in the inner part such that it is oriented in the same direction as the connecting pin when the latter is arranged inside the socket assembly together with the pinch seal. This direction typically corresponds to the direction of longitudinal extension of the lamp, which in turn coincides with the rotation axis about which the lamp is rotated for securing it in the socket assembly. To accommodate the connecting pin, the current collector rail advantageously has a channel-shaped region extending parallel to the rotation axis. Moreover, it preferably has at least one and more preferably two contact surfaces which extend (s) at the side of the channel-shaped region in the direction of the arching of the channel-shaped region, in the case of two contact surfaces preferably parallel to one another. These contact surfaces serve to establish an electrical contact between the connecting pin and the electric circuit of the socket assembly when the inner part inside the outer housing part is rotated to a closed position. As already described, the socket assembly is preferably configured such that a closed position is reached irrespective of whether the inner part in the outer housing part is rotated clockwise or counterclockwise. The contact surfaces arranged on both sides ensure that a reliable electrical contact is formed in both cases. The dimensions of the at least one contact surface are also based on the requirement that an electrical contact is established in a closed position, whereas in the open position this is not the case. In a simple variant, the at least one contact surface is configured as a rectangular stripe. It is, however, preferred to bend the end of the at least one contact surface facing away from the channel-shaped region such that in a closed position the contact is established via the bent region of the contact surface. In this manner, it is possible to establish a reliable contact across a relatively large contact surface.

The outer housing part and the inner part consist of a non-conductive material, in particular a plastic material, more particularly an injection-moldable plastic material. A material which has been found to be particularly suitable for this is polybutylene terephthalate (PBT). Glass-fiber reinforced polybutylene terephthalate is particularly preferably employed due to its high stability. If an injection molding process is used, the outer housing part and the inner part can be produced in a particularly cost-effective manner.

BRIEF DESCRIPTION OF THE DRAWINGS

The present invention will now be described in more detail with reference to the accompanying drawings. The drawings relate to preferred embodiments of the present invention without limiting the present invention to these embodiments. The figures are purely schematic and like parts are designated by like reference numerals, although not all parts are designated by reference numerals in all drawings. In the schematic drawings.

DETAILED DESCRIPTION OF THE INVENTION

Figure 1:
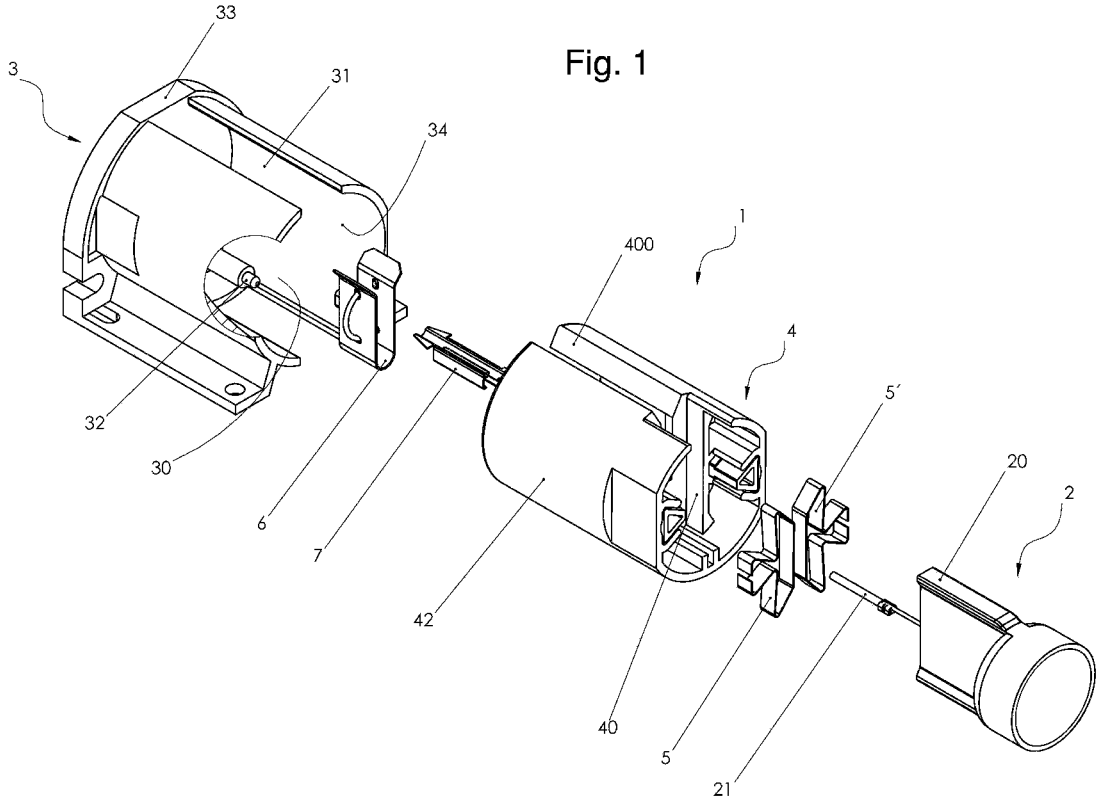
FIG. 1 is an exploded view of a socket assembly according to the present invention and a lamp for installation in the socket assembly.
Figure 2:
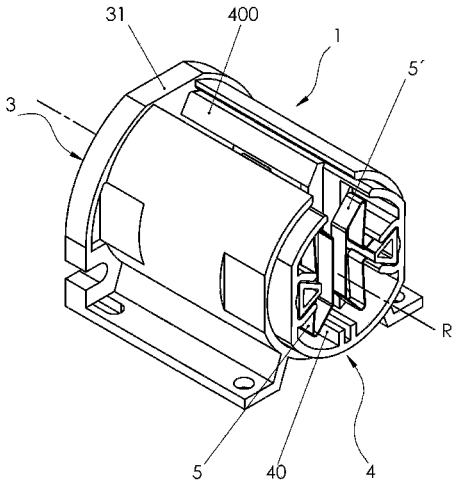
FIG. 2 is a perspective view of the socket assembly according to the present invention in an assembled state seen from the lamp side.

FIG. 1 shows a socket assembly 1 according to one embodiment of the present invention and a partial view of a lamp 2 which is to be inserted into the socket assembly 1. The socket assembly according to one embodiment of the present invention comprises an outer housing part 3 with an essentially cylindrical cavity 30 which is accessible from outside via a slotted opening 31 extending—with the exception of a faceplate 33—over the entire length of the outer housing part. The cavity 30 is adapted for insertion of an inner part 4 which has an essentially cylindrical external surface 42 that bears at least regionally against the wall 34 of the outer housing part 3 surrounding the cavity 30 in a form-closed manner. The outer housing part 3 is shown partly cut away so as to enable a view to the inside and support pin 32. FIG. 2 shows the inner part 4 inserted into the cavity 30. In this state, the inner part 4 is rotatable both clockwise and counterclockwise inside the outer housing part 3 about a rotation axis R extending in the direction of longitudinal extension of the inner part and the outer housing part.

Figure 3:
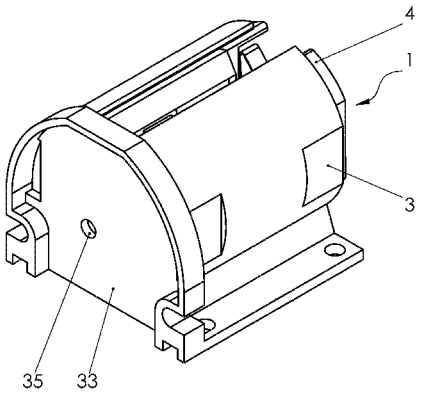
FIG. 3 shows the socket assembly of FIG. 2 seen from the side facing away from the lamp.
Figure 4:
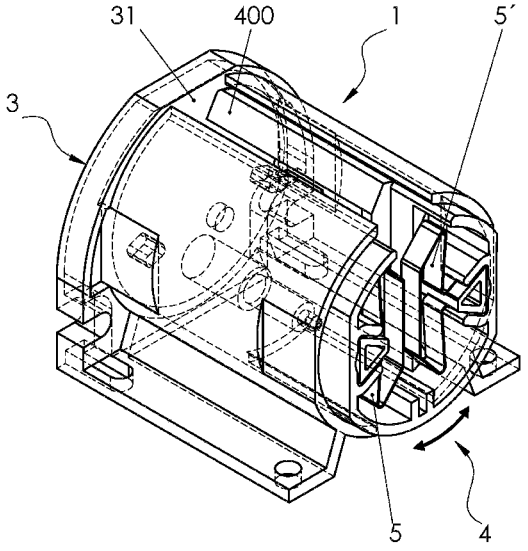
FIG. 4 shows the socket assembly of FIG. 2 with the outer housing part shown transparent.
Figure 5:
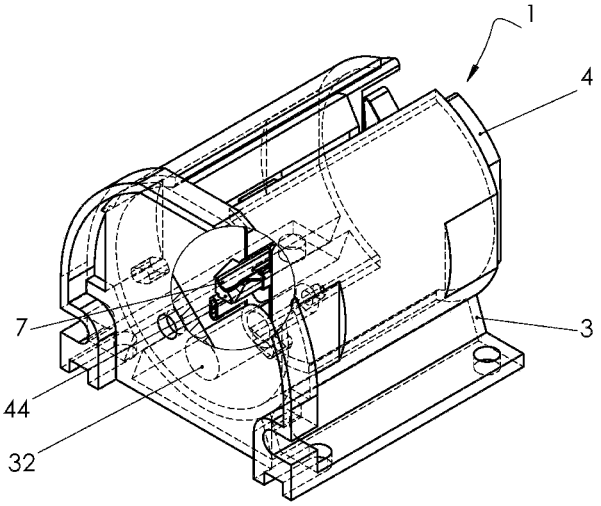
FIG. 5 shows the socket assembly of FIG. 3 with the outer housing part shown transparent.

In FIG. 4, which essentially corresponds to FIG. 2, except for the transparency of the outer housing part 3 to better illustrate the arrangement of the inner part 4 inside the outer housing part, the rotatability of the inner part is suggested by the double-headed arrow. FIGS. 3 and 5 show the socket assembly seen from the side facing away from the lamp with a view onto the faceplate 33, the outer housing part again being shown transparent and partly cut away in FIG. 5. The outer housing part 3 and the inner part 4 have been injection-molded from glass-fiber reinforced PBT.

Figure 8:
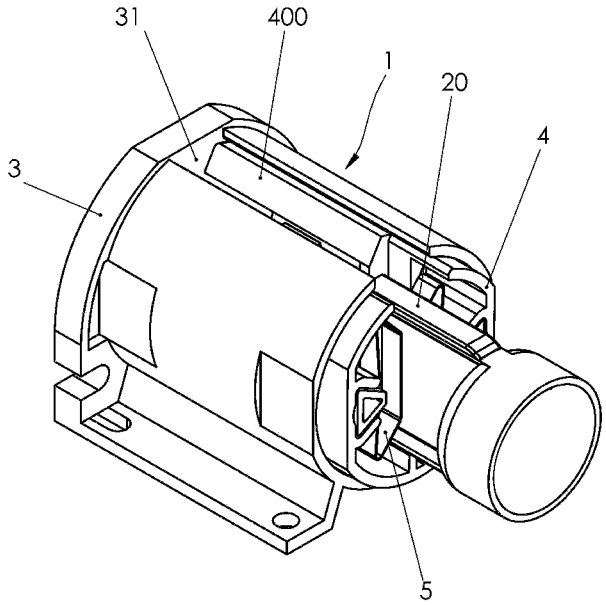
FIG. 8 shows the socket assembly of FIG. 2 with inserted lamp in an open position.
Figure 9:
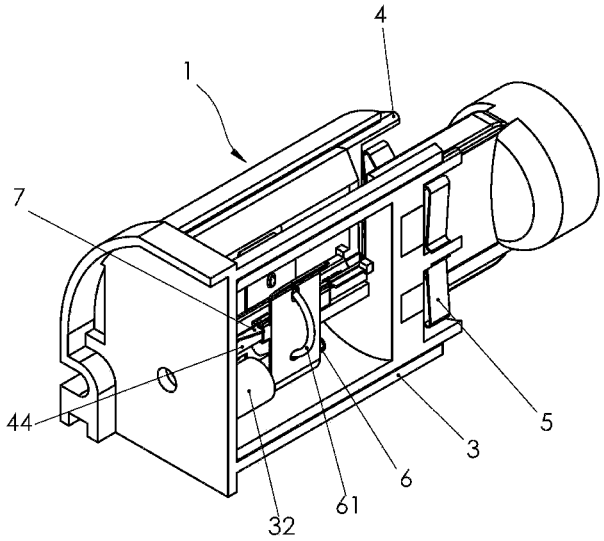
FIG. 9 is a cross-sectional view of the socket assembly of FIG. 8 along line X-X'.
Figure 16:
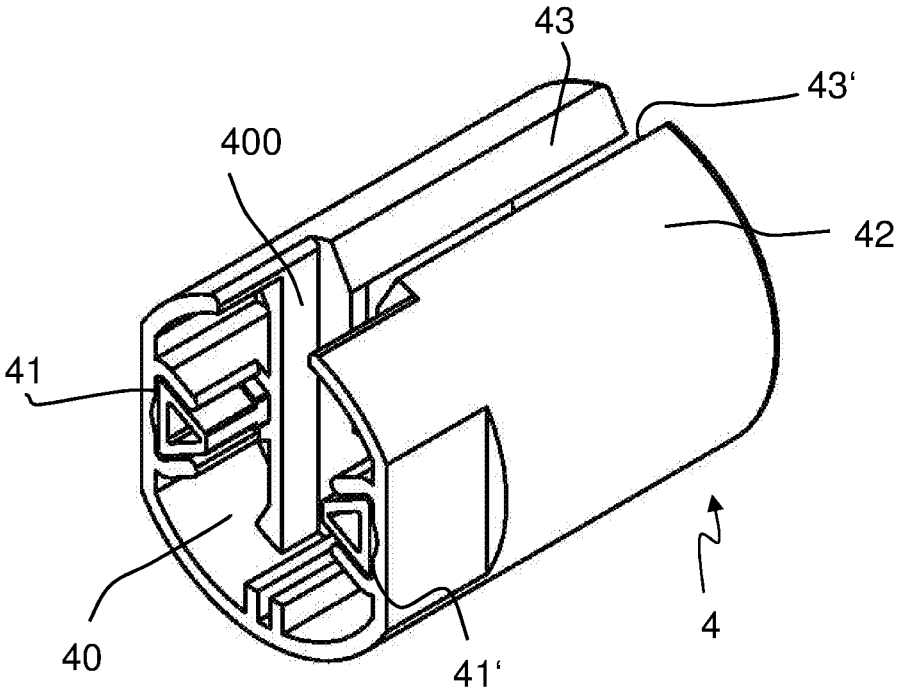
FIG. 16 is a perspective view of the inner part seen from the lamp side.

In each of FIGS. 1 to 5, the socket assembly is shown in an open position. In this position, the free space 40 in the interior of the inner part 4, which serves to receive the pinch seal 20 of the lamp 2 as well as the connecting pin 21 led out of the pinch seal 20 for electrically contacting the lamp, is accessible from outside via the slotted opening 31 and the gap 400 leading from the free space 40 to the external surface 42. The pinch seal 20 and the connecting pin 21 can thus be inserted into the free space 40 inside the inner part 4 through the slotted opening 31 and the gap 400 in a manner known per se. The insertion is facilitated by the inwardly beveled surfaces 43 and 43', which can be seen better in the enlarged illustrations of the inner part 4 in FIGS. 16 and 17 and are arranged such that the connecting pin 21 is inserted into the free space 40 in linear direction and oriented in the direction of the rotation axis. The gap 400 is widened towards the lamp side to be able to receive the pinch seal 20. FIGS. 8 and 9 show the pinch seal 20 and the connecting pin 21 after insertion into the socket assembly. Both Figures show the socket assembly in an open position in which the gap 400 and the slotted opening 31 are superimposed and the lamp 2 can be removed from the socket assembly.

Figure 10:
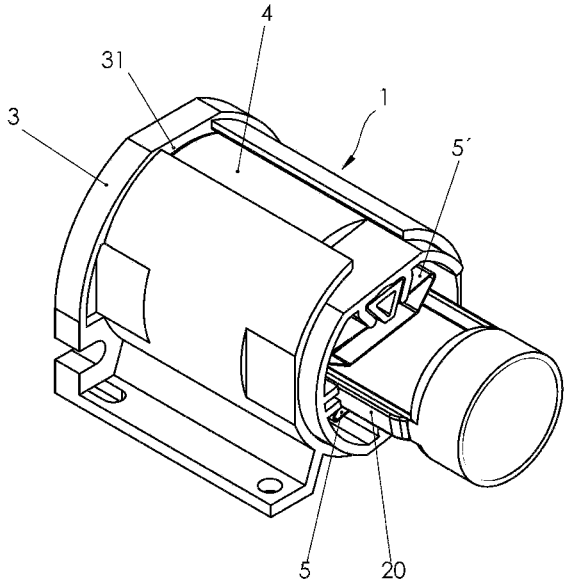
FIG. 10 shows the socket assembly of FIG. 8 in a closed position.
Figure 11:
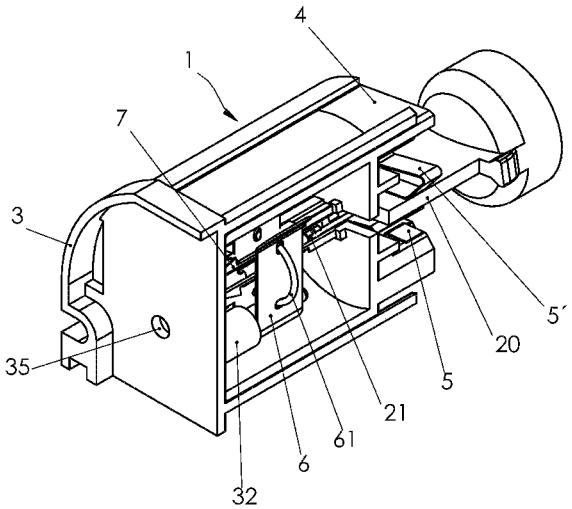
FIG. 11 shows the socket assembly of FIG. 9 in a closed position.

In contrast to this, FIGS. 10 and 11 show the arrangement of FIGS. 8 and 9 in a closed position. This position is reached through rotation of the lamp 2 together with the inner part 4 through 90° about the rotation axis R. In the example shown, the rotation was performed counterclockwise. However, a clockwise rotation would likewise result in a closed position in which the gap 400 and the slotted opening 31 are no longer congruent. In the closed position, the slotted opening 31 is closed by a portion of the external surface 42 of the inner part 4. The gap 400, which enables access to the free space 40, is likewise covered by the wall 34 of the outer housing part. In the closed position, the lamp 2 can thus no longer be removed from the socket assembly. In order to ensure rotation of the lamp and the inner part from the open position to a defined closed position, stop members, which are not shown here, may be provided which limit the rotation of the inner part 4 inside the outer housing part 3, in the shown example to 90°.

Figure 21:
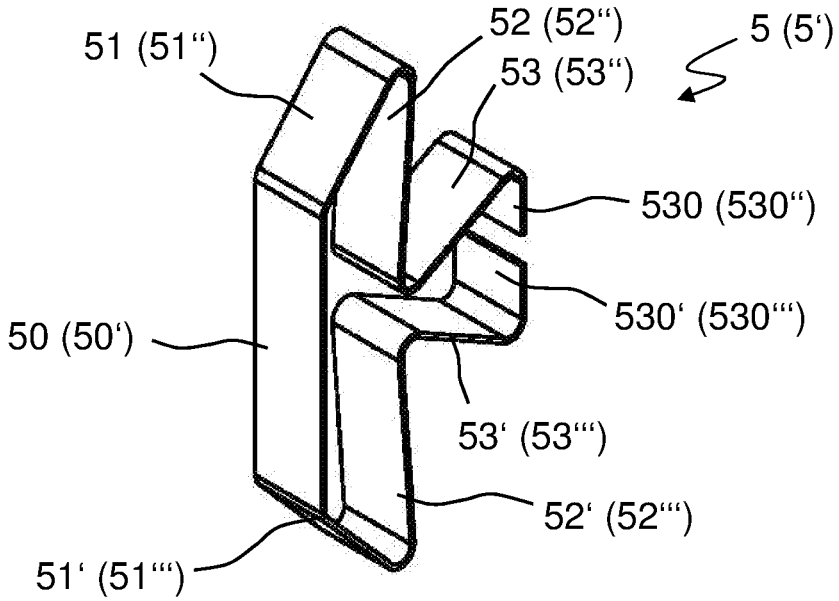
FIG. 21 is a perspective view of a leaf spring.
Figure 22:
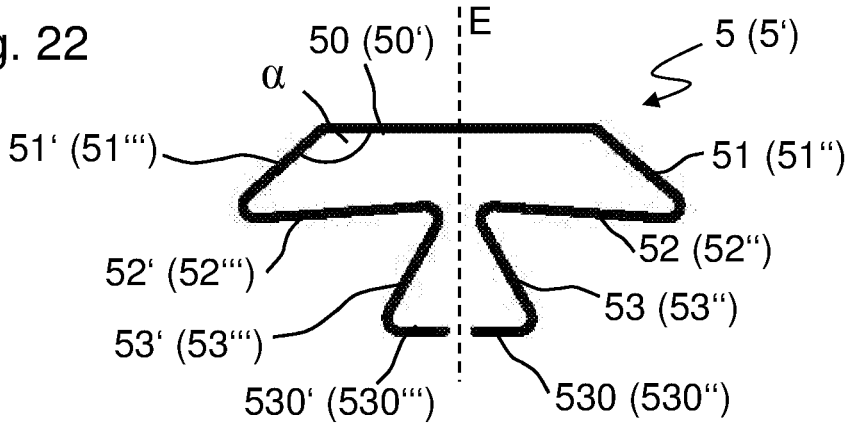
FIG. 22 is a side view of the leaf spring of FIG. 21.

The fixation of the pinch seal 20 in the socket assembly is achieved using the two leaf springs 5, 5' which are attached in the end face region of the inner part 4 facing the lamp 2. The two leaf springs are configured identically and arranged such that their head regions face each other. FIGS. 21 and 22 show enlarged illustrations. The leaf springs will now be described in more detail using the first leaf spring 5 as an example. The respective reference numerals for the second leaf spring 5' are indicated in brackets. The leaf spring is formed from a strip of spring steel such that a mushroom-like contour is obtained when seen in a side view (FIG. 22). In the head region, the leaf spring 5 has a flat resting face 50 adjoined on both sides by leg portions 51, 51'. Said leg portions are angled relative to the resting face 50 by an obtuse angle $\alpha$ of preferably 110 to 160°, more preferably 130 to 150°, and in the present case 140°. At the ends of the legs 51, 51' distant from the resting face, the metal strip is bent again to form base portions 52, 52' which run towards one another and slightly towards the resting face 50 in an inward direction. At the inner ends of the base portions, the metal strip is bent again such that the base portions are adjoined by shaft portions 53, 53' which extend away from the resting face 50 and open up in an outward direction. The outermost ends 530, 530' of the shaft portions, which at the same time constitute the free ends of the metal strip, are bent over in an inward direction relative to the shaft portions 53, 53' and run towards one another parallel to the resting face 50. This results in a leaf spring that is mirror-symmetrical with respect to the central plane E, with an approximately trapezoidal head region and a shaft region defined by the shaft portions 53, 53', 530, 530' which, in the shown example, has a contour shape of an approximate isosceles triangle.

The leaf spring 5 is attached to the inner part 4 in its shaft region, which is achieved by an arrangement in which the shaft portions 53, 53', 530, 530' are slipped into a complementary, approximately triangular groove 41 in the end face region of the inner part 4 adjacent to the lamp 2. As can be taken, in particular, from FIG. 16, said groove 41 is located in a projection of the inner part 4 which tapers towards the free space 40. The head region of the leaf spring 5 protruding beyond the shaft region, i.e., the base portions 52, 52', the leg portions 51, 51', and the resting face 50, can therefore deform relatively freely, for example tilt relative to the shaft region or back away towards the shaft region, so that the distance between the resting faces 50 and 50' of the opposed leaf springs can increase when the pinch seal 20 is inserted into the gap between the leaf springs 5 and 5'. This facilitates the insertion of the pinch seal into the socket assembly and reduces the pressure applied thereon during attachment, so that the risk of damage is significantly reduced. Similar to the beveled surfaces 43, 43' of the inner part 4, the leg portions 51 to 51''' of the two leaf springs 5, 5', which protrude outward in a V-like manner, serve as guide faces and further facilitate the insertion of the pinch seal 20 into the free space 40 of the inner part 4. Once the pinch seal 20 has been fully inserted into the free space 40, the leaf springs 5 and 5' bear with their resting faces 50, 50' against its surfaces across nearly the complete width of the pinch seal 20 on both sides and secure it without creating a very high pressure per unit area at any location. The described arrangement also allows a removal of the lamp from the socket assembly without application of large forces.

Figure 17:
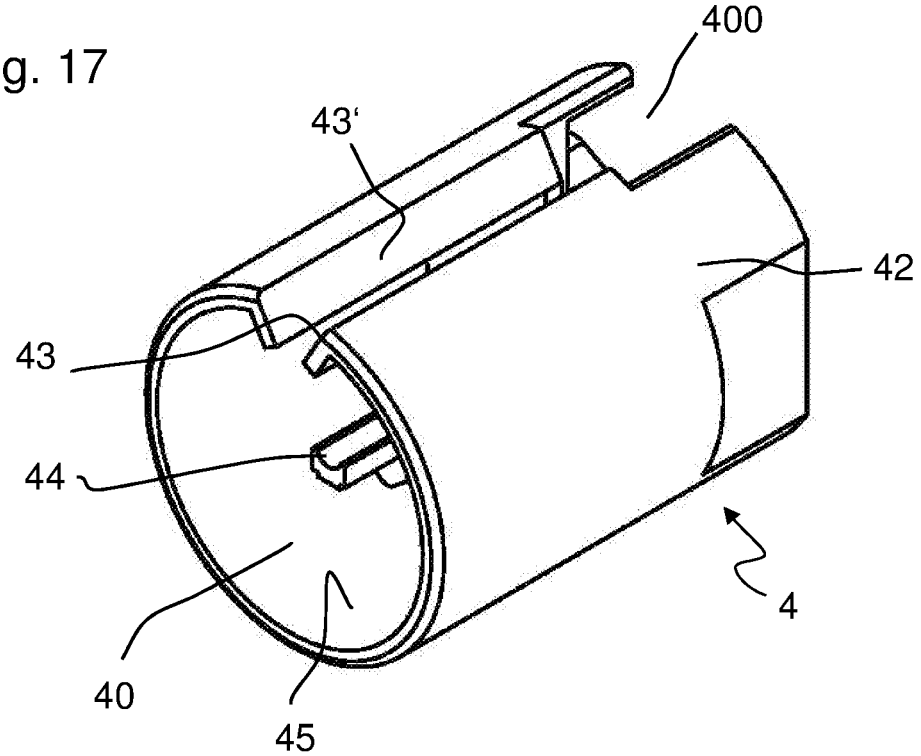
FIG. 17 shows the inner part of FIG. 16 seen from the side facing away from the lamp.
Figure 18:
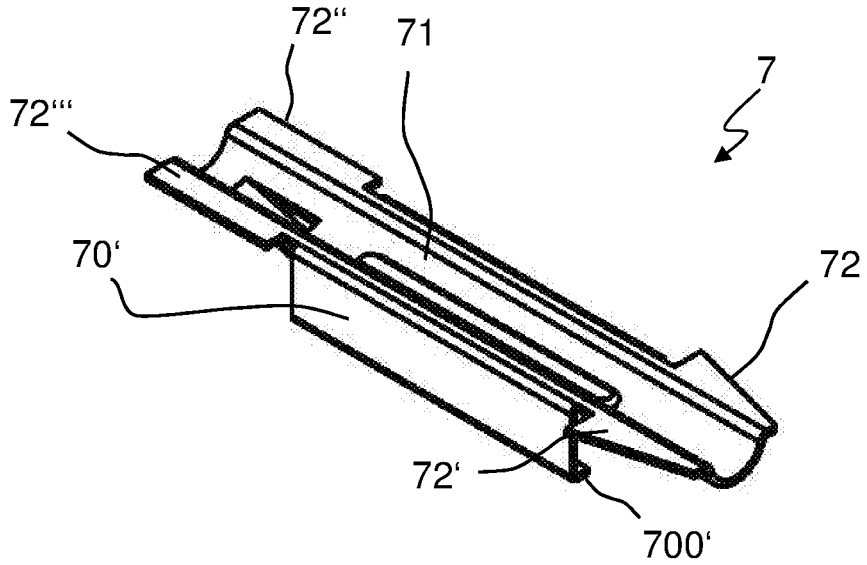
FIG. 18 is a perspective view of a current collector rail.
Figure 19:
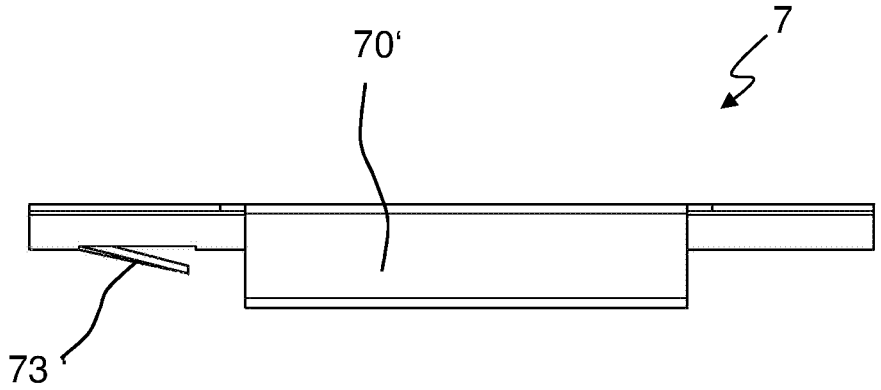
FIG. 19 is a side view of the current collector rail of FIG. 18.
Figure 20:
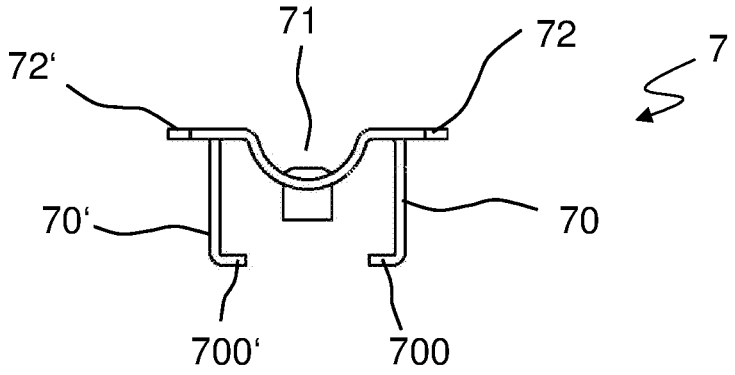
FIG. 20 is a top view of the right end face of the current collector rail of FIG. 18.

Once the pinch seal 20 has been inserted to the desired position inside the socket assembly, the connecting pin 21 comes to rest in the channel-shaped region 71 of the current collector rail 7, which is in turn arranged on a support projection 44 protruding into the free space 40 of the inner part 4 (see FIG. 17). The details of the current collector rail 7 are best seen in FIGS. 18 to 20. The current collector rail 7 consists of an electrically conductive material, in particular a metal, and serves to establish an electrical contact between the connecting pin 21 and thus the lamp 2 and the current-carrying elements of the socket assembly, which in turn has an external voltage source, which is not shown here, connected to it. The current collector rail 7 is in this case configured such that an electrical contact is established only in a closed position of the socket assembly but not in the open position. In the open position, the current collector rail 7 is arranged on the holding projection 44 such that the lateral contact surfaces 70, 70', which extend on both sides of the channel-shaped region 71 and parallel to one another in the direction of the channel arching, face away from the slotted opening 31 and the gap 400. The projections 72 to 72''' as well as the barb 73 serve to fix the position of the current collector rail 7 on the support projection 44. When the lamp 2 is rotated inside the socket assembly from the open position to a closed position to secure it, the inner part 4 rotates inside the outer housing part 3 together with the holding portion 44 with the current collector rail 7 arranged thereon. The contact surfaces 70, 70', which have ends 700, 700' that are bent at right angles towards one another, thus also pivot through 90°. As a result, they come into contact with the contact spring 6, which is mounted at a support projection in the form of a support pin 32 inside the cavity 30 of the outer housing part 3.

Figure 7:
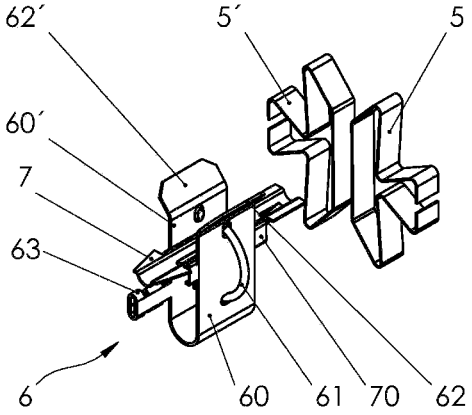
FIG. 7 illustrates the internals of FIG. 6 separately without the inner part.
Figure 12:
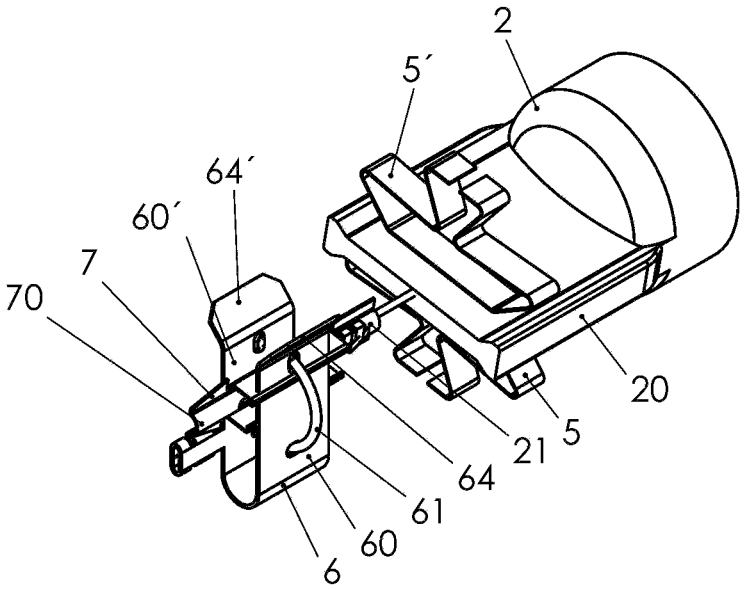
FIG. 12 shows the internals of the socket assembly of FIG. 11 with inserted lamp but without the inner part and the outer housing part.
Figure 13:
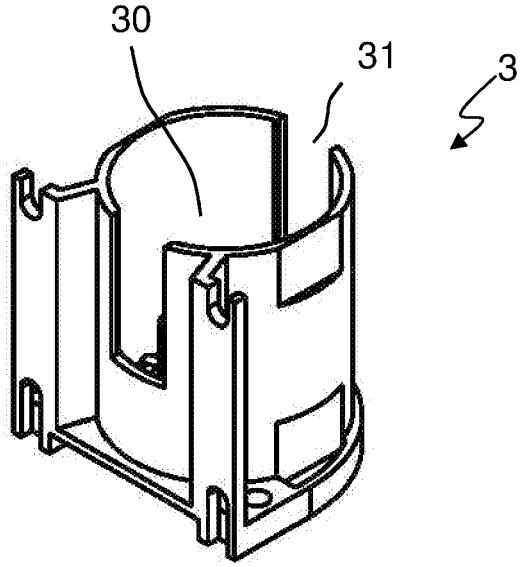
FIGS. 13 to 15 are various perspective views of the outer housing part.
Figure 14:
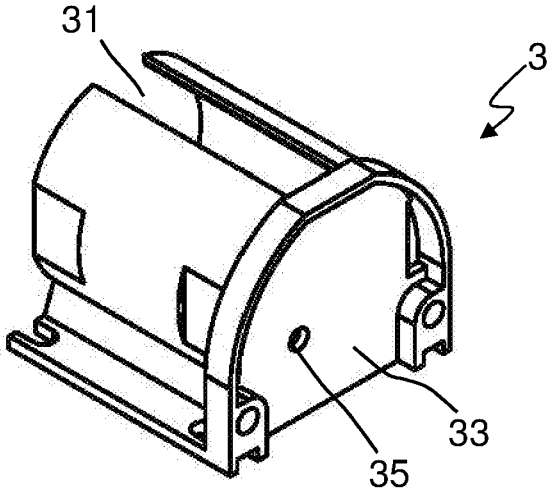
Figure 15:
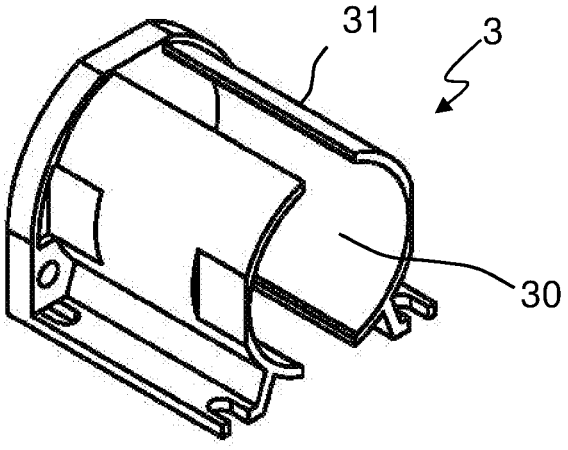
Figure 23:
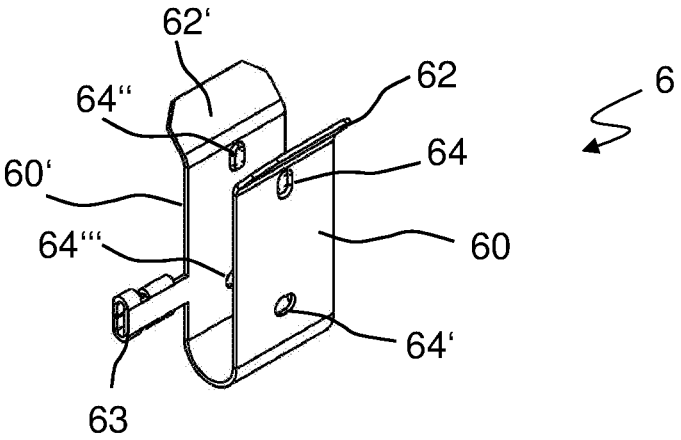
FIG. 23 is a perspective view of a contact spring.

Details of the contact spring 6 are best seen in FIGS. 7, 12 and 23. It has an essentially U-shaped body made of an electrically conductive material, for example a metal sheet. The legs 60, 60', which are connected by a rounded connecting section and extend parallel to one another, have at their free ends end regions 62, 62' that are flared outwards and can provide lateral support for the contact spring 6 in the free space 40 of the inner part 4, which is in this region cylindrical. A cable terminal 63 which can be connected to an electric cable, which is omitted here, is arranged in a lower region of the leg 60. This electric cable is led outside through the opening 35 in the faceplate 33 of the outer housing part 3 and connected to an external voltage source, which is also omitted. The contact spring 6 further has four openings 64 to 64*m*. These openings serve to attach an open spring ring 61. The two ends of the spring ring 61 are in this case inserted into the upper openings 64, 64" and attached therein, while the ring is led through the lower openings 64, 64*m*. The spring ring 61 holds, on the one hand, the contact spring 6 on the support pin 32, additionally preloads the contact spring and forms lateral projections on the external sides of the legs 60, 60' which aid in compressing the contact spring 6 when the socket assembly is moved to a closed position.

Figure 6:
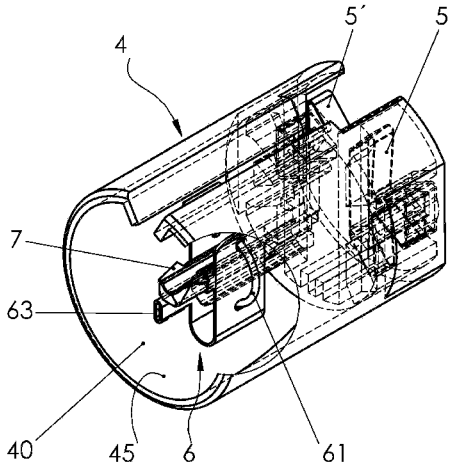
FIG. 6 is a perspective view of an inner part with internals, with the inner part shown transparent and partly cut away.

As can be seen in FIGS. 6 and 7, the current collector rail 7 is already arranged between the legs 60, 60' of the contact spring 6 when the socket assembly is still in the open position, however without contacting the spring. The contact surfaces 70, 70', which extend parallel to the legs 60, 60', as well as the inwardly bent ends 700, 700' are spaced from the contact spring 6. Therefore, there is no flow of current from the contact spring 6 via the current collector rail 7 and the connecting pin 21 to the lamp in the open position. If, however, the lamp 2 is rotated through 90° about the rotation axis R (FIGS. 10 to 12), the contact surfaces 70, 70' come to rest orthogonally to the legs 60, 60', and the bent end regions 700, 700' bear against one of the legs, in the shown example the leg 60'. Now, a current can flow via the contact spring 6 and the current collector rail 7 to the connecting pin 21 and on to the lamp 2.

As already described above, the socket assembly may be configured such that the free space 40 is reduced upon rotation from the open position to a closed position to thereby compress the various springs used in the socket assembly. In a first variant, this causes exertion of pressure on the contact spring 6, in the shown example specifically the parts of the spring ring 61 which protrude beyond the external sides of the legs 60, 60'. In the shown example, this is achieved through the fact that the cavity 30 is not exactly cylindrical but is slightly oblate on the side of the slotted opening 31 and the side opposite said side, so that it has a smaller diameter in these regions than in the regions shifted by 90° with closed wall 34. As a result, upon rotation from the open position to a closed position shifted by 90°, the inner part 4 is somewhat compressed from the side of the slotted opening 31 and the opposite side. This causes a reduction of the distance between the wall 45 of the inner part 4, which surrounds the free space 4, and the legs 60, 60' of the contact spring 6. The wall 45 abuts the lateral projections of the spring ring 61 and compresses the contact spring 6, so that the contact between the internal side of the leg 60' and the ends 700, 700' of the contact surfaces 70, 70' is increased.

The reduction of the free space 40 also has a similar effect on the leaf springs 5, 5'. When the inner part 4 is rotated to a closed position, the resting faces 50, 50' are brought closer together, so that they bear against the pinch seal 20 with increased pressure and thus fix it particularly reliably. Upon rotation of the socket assembly back to the open position, the free space 40 widens again, the pressure on the springs is reduced, and the lamp can be removed from the socket assembly more easily. This also reduces the risk of damage to the pinch seal 20.

While the present invention present has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A socket assembly for receiving a lamp having a pinch seal and a connecting pin led out therethrough, comprising:

an outer housing part with an essentially cylindrical cavity which is accessible from outside via a slotted opening extending in a longitudinal direction of the outer housing part, an inner part mounted for rotation about a rotation axis (R) inside the outer housing part and including a free space which is configured for receiving the pinch seal and the connecting pin and which is accessible from outside, and two opposed leaf springs for fixation of the pinch seal in the free space, wherein each of the leaf springs is bent from a metal strip such that a linear resting face is formed which is adjoined on both sides by leg portions that are angled relative to the resting face and that are adjoined, at their ends distant from the resting face, by base portions running towards one another, said base portions turning into shaft portions that extend away from the resting face, wherein said leaf springs are attached to the inner part in the region of the shaft portions and the resting faces face each other and are essentially parallel to one another.

2. The socket assembly according to claim 1, wherein the leg portions extend at an obtuse angle an angle ($\alpha$) in the range from 110 to 160° to the resting face.

3. The socket assembly according to claim 2, wherein said angle ($\alpha$) is equal for both leg portions of at least one of the leaf springs.

4. The socket assembly according to claim 1, wherein the leaf springs are mirror-symmetrical with respect to a central plane (E) perpendicular to the rotation axis (R) and have a mushroom-like contour shape.

5. The socket assembly according to claim 1, wherein the leaf springs are attached to the inner part only in their region of the shaft portion that is distant from the respective resting face such that their regions projecting over the respective shaft portion are deformable towards the shaft region.

6. The socket assembly according to claim 1, wherein free ends of the shaft portions are bent towards one another and end regions of the shaft portions are slipped into complementary grooves formed in the inner part.

7. The socket assembly according to claim 1, wherein a contact spring with an essentially U- or V-shaped body is mounted in a free space at a support projection of the outer housing part protruding into the free space and is configured to be connected to an external voltage source, wherein an electrical contact with a contact surface of a current collector rail that extends between the legs of the contact spring, is attached to the inner part and is rotatable therewith is established when the inner part is moved through rotation about the rotation axis (R) from an open position in which the free space is accessible via the slotted opening of the outer housing part to a closed position in which the free space is no longer accessible via the slotted opening, and in which the connecting pin bears against the current collector rail thereby forming an electrical contact.

8. The socket assembly according to claim 7, wherein a lateral projection is provided on at least one external side of a leg of the contact spring, wherein a sidewall region delimiting the free space rests against said projection when the inner part is in a closed position, so that the legs are pressed against one another thereby establishing a contact with the contact surface of the current collector rail.

9. The socket assembly according to claim 7, wherein the current collector rail has a channel-shaped region extending parallel to the rotation axis (R) and two contact surfaces extending on both sides of the channel-shaped region and parallel to one another in the direction of an arching of the channel-shaped region.

10. The socket assembly according to claim 1, wherein at least one of the following properties applies:

a circumferential portion of the essentially cylindrical cavity has, at least in regions in the direction of the rotation axis (R), a diameter which is reduced relative to a circular cross-section;

a circumferential portion of the inner part has, at least in regions in the direction of the rotation axis (R), a diameter which is enlarged relative to a circular cross-section, wherein the change in diameter is such that, upon rotation of the inner part about the rotation axis (R) from an open position in which the free space is accessible via the slotted opening of the outer housing part to a closed position in which the free space is no longer accessible via the slotted opening, the free space is reduced at least in the region of the leaf springs and/or the contact spring.

11. The socket assembly according to claim 1, wherein the outer housing part and/or the inner part are made of a plastic material.

12. The socket assembly according to claim 11, wherein the outer housing part and/or the inner part are made of polybutylene terephthalate.

13. The socket assembly according to claim 11, wherein the outer housing part and/or the inner part are made of glass-fiber reinforced polybutylene terephthalate.

14. The socket assembly according to claim 11, wherein the outer housing part and/or the inner part are made of injection-molded part.

15. The socket assembly according to claim 1, wherein the leg portions extend at an obtuse angle an angle ($\alpha$) in the range from 130 to 150° to the resting face.

16. The socket assembly according to claim 15, wherein said angle ($\alpha$) is equal for both leg portions of at least one of the leaf springs.

* * * * *